US009579877B2

(12) United States Patent
Pekurovsky

(10) Patent No.: US 9,579,877 B2
(45) Date of Patent: Feb. 28, 2017

(54) FLEXOGRAPHIC PRINTING WITH CURING DURING TRANSFER TO SUBSTRATE

(71) Applicant: 3M INNOVATIVE PROPERTIES COMPANY, St. Paul, MN (US)

(72) Inventor: Mikhail L. Pekurovsky, Bloomington, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 15/092,163

(22) Filed: Apr. 6, 2016

(65) Prior Publication Data

US 2016/0214371 A1 Jul. 28, 2016

Related U.S. Application Data

(62) Division of application No. 12/514,906, filed as application No. PCT/US2007/083322 on Nov. 1, 2007, now Pat. No. 9,340,053.

(60) Provisional application No. 60/865,968, filed on Nov. 15, 2006.

(51) Int. Cl.

| | |
|---|---|
| ***B41F 5/24*** | (2006.01) |
| ***B41F 3/54*** | (2006.01) |
| ***B41F 23/04*** | (2006.01) |
| ***B41M 1/04*** | (2006.01) |
| *B41M 7/00* | (2006.01) |

(52) U.S. Cl.

CPC ..... *B41F 3/54* (2013.01); *B41F 5/24* (2013.01); *B41F 23/04* (2013.01); *B41F 23/0409* (2013.01); *B41M 1/04* (2013.01); *B41M 7/009* (2013.01); *B41M 7/0081* (2013.01); *B41P 2200/12* (2013.01)

(58) Field of Classification Search

CPC ..... B41F 5/24; B41F 2200/12; B41M 1/04; B41M 7/0081; B41M 7/009

See application file for complete search history.

(56) References Cited

U.S. PATENT DOCUMENTS

| | | | |
|---|---|---|---|
| 3,264,103 | A | 8/1966 | Cohen |
| 4,209,551 | A | 6/1980 | Fukuyoshi |
| 4,323,636 | A | 4/1982 | Chen |
| 4,323,637 | A | 4/1982 | Chen |
| 4,427,759 | A | 1/1984 | Gruetzmacher |
| 4,460,675 | A | 7/1984 | Gruetzmacher |
| 4,576,850 | A | 3/1986 | Martens |

(Continued)

FOREIGN PATENT DOCUMENTS

| | | | |
|---|---|---|---|
| CN | 1487362 | | 4/2004 |
| CN | 1541852 | A | 11/2004 |

(Continued)

OTHER PUBLICATIONS

Bruno, M., "Printing Meets Lithography" The Industrial Physicist, (2002) XP009099601.

(Continued)

*Primary Examiner* — Justin Olamit
(74) *Attorney, Agent, or Firm* — Yufeng Dong

(57) ABSTRACT

Methods and systems for flexographic printing are described and include curing of material to be printed while the material is in contact with both a feature of a flexographic printing plate and a recipient substrate. The systems and method are useful in preventing slippage between the feature and the recipient substrate, and are particularly useful when printing at high resolution.

12 Claims, 10 Drawing Sheets

(56) References Cited

U.S. PATENT DOCUMENTS

| | | | |
|---|---|---|---|
| 4,726,877 | A | 2/1988 | Fryd |
| 4,753,865 | A | 6/1988 | Fryd |
| 4,894,315 | A | 1/1990 | Feinberg |
| 4,956,252 | A | 9/1990 | Fryd |
| 5,015,556 | A | 5/1991 | Martens |
| 5,116,548 | A | 5/1992 | Mallik |
| 5,175,072 | A | 12/1992 | Martens |
| 5,215,859 | A | 6/1993 | Martens |
| 5,279,697 | A | 1/1994 | Peterson |
| 5,407,708 | A | 4/1995 | Lovin |
| 5,535,673 | A | 7/1996 | Bocko |
| 5,540,147 | A | 7/1996 | Johnson |
| 5,701,815 | A | 12/1997 | Bocko |
| 5,707,773 | A | 1/1998 | Grossman |
| 5,929,961 | A | 7/1999 | Nishi |
| 5,972,565 | A | 10/1999 | Dudek |
| 6,045,894 | A | 4/2000 | Jonza |
| 6,737,154 | B2 | 5/2004 | Jonza |
| 6,758,936 | B1 | 7/2004 | Kiekhaefer |
| 6,764,014 | B2 | 7/2004 | Lasch |
| 7,614,712 | B2 | 11/2009 | Kachi |
| 2004/0032050 | A1 | 2/2004 | Maier |
| 2004/0099388 | A1 | 5/2004 | Chen |
| 2005/0019508 | A1 | 1/2005 | Engel |
| 2005/0196701 | A1 | 9/2005 | Rapp |
| 2005/0238967 | A1 | 10/2005 | Rogers |
| 2005/0241513 | A1 | 11/2005 | Yoo |
| 2005/0241519 | A1 | 11/2005 | Aylor |
| 2006/0018021 | A1 | 1/2006 | Tonkins |
| 2006/0230969 | A1 | 10/2006 | Vosahlo |
| 2006/0234605 | A1 | 10/2006 | Bryan |
| 2006/0272534 | A1 | 12/2006 | Liberman |
| 2010/0077932 | A1 | 4/2010 | Pekurovsky |
| 2011/0182805 | A1 | 7/2011 | DeSimone |

FOREIGN PATENT DOCUMENTS

| | | |
|---|---|---|
| DE | 197 36 339 | 4/1999 |
| EP | 0 558 010 | 9/1993 |
| EP | 0 730 148 | 9/1996 |
| EP | 1 657 070 | 5/2006 |
| EP | 1 700 680 | 9/2006 |
| JP | 50-71413 | 6/1975 |
| JP | 51-145605 | 12/1976 |
| JP | 52-123707 | 10/1977 |
| JP | 54-154606 | 12/1979 |
| JP | 4-10933 | 1/1992 |
| JP | 8-309961 | 11/1996 |
| JP | 2001-171066 | 6/2001 |
| JP | 2001-287473 | 10/2001 |
| JP | 2002-196479 | 7/2002 |
| JP | 2002-223095 | 8/2002 |
| JP | 2004-095882 | 3/2004 |
| JP | 2004-216621 | 8/2004 |
| JP | 2004-268319 | 9/2004 |
| JP | 2005-081566 | 3/2005 |
| JP | 2005-144923 | 6/2005 |
| JP | 2006-056049 | 3/2006 |
| WO | 00/30854 | 6/2000 |
| WO | 00/34400 | 6/2000 |
| WO | 01/12342 | 2/2001 |
| WO | 01/74589 | 10/2001 |
| WO | 2004/090636 | 10/2004 |
| WO | 2005/109095 | 11/2005 |
| WO | 2008/060918 | 5/2008 |
| WO | 2008/060876 | 12/2008 |

OTHER PUBLICATIONS

Elsner, C., et al., "3D-microstructure replication processes using UV-curable acrylates", Microelectronic Engineering, Elsevier Publishers BV., Amsterdam, NL, vol. 65, No. 1-2 (Jan. 1, 2003) pp. 163-170.

Kim, E., et al., "Solvent-Assisted Microcontact Molding: A Convenient Method for Fabricating Three-Dimensional Structures on Surfaces of Polymers", Advanced Materials, Wiley VCH, Weinheim, DE, vol. 9, No. 8, (Jun. 1, 1997), pp. 651-654.

Kumar A., et al., "Patterning Self-Assembled Monolayers: Applications in Materials Science", Langmuir, vol. 10, pp. 1498-1499, (May 31, 1994).

Lee, H.H., et al., "Fabrication of large-area stamps, moulds, and conformable photomasks for soft lithography", Proceedings of the Institution of Mechanical Engineers, Part N (Journal of Nanoengineering and Nanosystems) Mec. Eng. Publications UK, vol. 218, No. N1, (2005) pp. 1-5.

Lindvold, et al., "UV assisted rotational moulding of microstructures using a conventional flexographic printing machine", SPIE, vol. 4984, (2003), pp. 46-53.

Xia, Y., et al., "Soft Lithography" Annual Review of Materials Science, Annual Reviews, Inc., Palo Alto, CA, US, vol. 28, (Jan. 1, 1998), pp. 153-184.

Zhao, et al., "Rapid fabrication of a poly(dimethylsiloxane) microfluidic capillary gel electrophoresis system utilizing high precision machining" LAB CHIP, vol. 3, (2003) pp. 93-99.

U.S. Appl. No. 60/865,974, entitled "Card With Abrasion-Resistant Coating", to John H. Ko, et al., filed Nov. 15, 2006, now expired—all family cancelled/aband.

FLEXOGRAPHIC PRINTING WITH CURING DURING TRANSFER TO SUBSTRATE

CROSS-REFERENCE TO RELATED APPLICATIONS

This is a divisional filing of U.S. Ser. No. 12/514,906, filed Aug. 4, 2009, which is a national stage filing under U.S.C. 371 of PCT/US2007/083322, filed Nov. 1, 2007, which claims the benefit of U.S. Provisional Ser. No. 60/865,968, filed Nov. 15, 2006.

FIELD

This disclosure relates to printing; particularly to flexographic printing; and more particularly to high resolution flexographic printing.

BACKGROUND

Dot gain is a well known problem in the flexographic printing industry. It is understood that dot gain on a printed web can be partially attributed to a relative slippage between printing features of the flexographic printing plate and the surface of the web being printed. Slippage happens in the nip between a deformable printing tool and a back-up roll and is due to either incompressibility of the material of the printing plate or mismatch of surface velocities of the printing plate and the web. Dot gain for small features is more pronounced than for large features. This is because slippage of a small distance is considerably larger relative to a small dot than the same slippage distance with a considerably larger dot.

BRIEF SUMMARY

The disclosure presented herein described methods and systems for improved flexographic printing by curing material transferred from a flexographic printing plate to a recipient substrate while the material is in contact with both a feature of the plate and the recipient substrate.

In an embodiment, a method for flexographic printing is described. The method comprises transferring a curable material from a donor substrate to a feature of a flexographic printing plate; and transferring the curable material from the feature of the flexographic printing plate to a recipient substrate. The method further comprises curing the material while the material is in contact with both the feature and the recipient substrate. The curing may comprise exposing the material to energy, such as e-beam radiation, UV radiation, or heat. The method may further comprise reducing the oxygen content in the environment of the curing material, e.g., by introducing nitrogen into the curing environment. In addition, the method may comprise precuring the material prior to transferring the material from the feature of the flexographic printing plate to the recipient substrate. The method may also further comprise removing solvent from a material prior to transfer of the curable material from the donor substrate to the feature of the printing plate. The method is useful for features of any size. However, the advantages of the method may be more recognized when using features having a lateral dimension of 15 micrometers or less; e.g., 10 micrometers or less, or 5 micrometers or less.

In an embodiment, a system for flexographic printing is described. The system comprises a flexographic roll configured to attachably receive a flexographic printing plate comprising one or more features. The features are capable of transferring a curable material to a recipient substrate. The system further comprises a backup roll positioned relative to the flexographic roll such that movement of the backup roll relative to the flexographic roll is capable of causing a recipient substrate to move between the backup roll and the flexographic roll to allow the curable material to be transferred from the features to the recipient substrate. The system further comprises a first energy source for curing the material, the first energy source being positioned to cause curing of the material while the material is in contact with the features and the recipient substrate. The first energy source may be capable of emitting energy, e.g., UV radiation, e-beam radiation, or heat. The system may further comprise a second energy source for pre-curing the material. The second energy source is positioned to cause pre-curing of the material prior to transfer of the material from the feature to the recipient substrate. The system may further comprise a nitrogen infusion apparatus configured to introduce nitrogen at a location where material is transferred from the feature to the recipient substrate. The system is useful for flexographic printing plates having features of any size. However, the advantages of the system may be more recognized when using plates having features with a lateral dimension of 15 micrometers or less; e.g., 10 micrometers or less or 5 micrometers or less.

The methods and systems described herein provide several advantages. For example, curing material while it is in contact with both a feature of a flexographic printing plate and a recipient substrate prevents slippage between the feature and the recipient substrate. In addition, as flexographic printing involves use of solvent-based materials, removal of solvent, as described in embodiments herein, not only allows for the material to be cured while it is in contact with both a feature of a flexographic printing plate and a recipient substrate, but also facilitates the deposition of the material on a donor substrate because the material can comprise solvent that will be later removed. These and other advantages of the systems and methods described herein are now evident or will become evident upon reading the description that follows.

Figure 1:
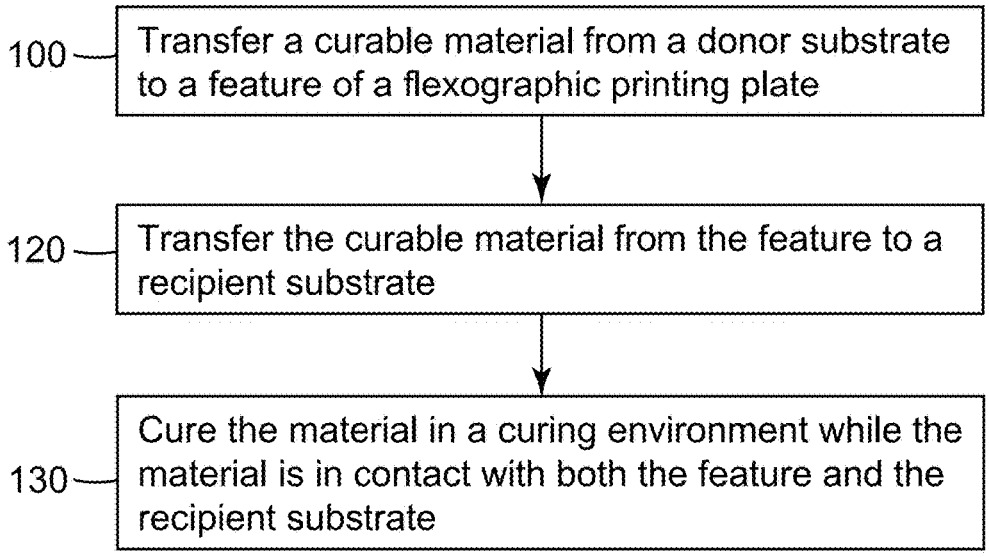
FIGS. 1-4 are flow diagrams of flexographic printing methods.

The figures are not necessarily to scale. Like numbers used in the figures refer to like components, steps and the like. However, it will be understood that the use of a number to refer to a component in a given figure is not intended to limit the component in another figure labeled with the same number.

DETAILED DESCRIPTION

In the following description, reference is made to the accompanying drawings that form a part hereof, and in which are shown by way of illustration several specific embodiments. It is to be understood that other embodiments are contemplated and may be made without departing from the scope or spirit of the present invention. The following detailed description, therefore, is not to be taken in a limiting sense.

Overview

Curing printable material while it is in contact with both a feature of a flexographic printing plate and a recipient substrate prevents slippage between the feature and the recipient substrate and increases fidelity of flexographic printing. While this is the case for flexographic printing plates having features of any size, the benefits of transfer of reduced-solvent material will be more evident with features having smaller lateral dimensions. In part this is because existing flexographic printing systems have lateral dimensions greater than about 20 micrometers and the amount of slippage relative to features of such large sizes is comparatively small. However, as the lateral dimensions of the features decrease much beyond the current limitations of the size of the features; i.e., less than about 15 to 20 micrometers, the relative size of the slippage increases. The methods and systems described herein allow for the curing of material while it is in contact with both the feature of the flexographic printing plate and the recipient substrate.

The methods and systems described herein may be used with flexographic printing plates having features of any size. However, the advantages of the methods and systems may be more recognized when using features having a lateral dimension of 15 micrometers or less; e.g., 10 micrometers or less, or 5 micrometers or less. Flexographic plates having features with lateral dimensions of 15 micrometers or less may be as described in, e.g., U.S. Provisional Patent Application Ser. No. 60/865,979, entitled "SOLVENT-ASSISTED EMBOSSING OF FLEXOGRAPHIC PRINTING PLATES" to Pekurovsky, et al., filed on even date herewith, which application is incorporated herein by reference in its entirety to the extent that it does not contradict the disclosure presented herein.

Definitions

All scientific and technical terms used herein have meanings commonly used in the art unless otherwise specified. The definitions provided herein are to facilitate understanding of certain terms used frequently herein and are not meant to limit the scope of the present disclosure.

As used herein, "flexographic printing" means a rotary printing using a flexible printing plate; i.e., a flexographic printing plate. Any material that may be transferred from a flexographic printing plate to a recipient substrate may be "printed".

As used herein, a "material" to be printed means a composition that is capable of being transferred from a feature of a flexographic printing plate to a recipient substrate. A material may comprise a solvent, and various components dissolved, dispersed, suspended, or the like in the solvent.

As used herein, "curing" means a process of hardening of a material. Typically, curing refers to increasing cross-linking within the material. A "curable" material thus refers to a material that may be hardened, typically through cross-linking. A material may be partially cured or fully cured. As used herein, a material that is "pre-cured" is a material that is partially cured. It will be understood that curing subsequent to pre-curing may result in a partially cured or fully cured material. As used herein, "curing environment" means the environment in which curing occurs.

As used herein, "flexographic printing plate" means a printing plate having features onto which material to be transferred to a recipient substrate may be disposed, wherein the plate or the features are capable of deforming when contacting the recipient substrate (relative to when not contacting the recipient substrate). A flexographic printing plate may be a flat plate that can be attached to a roll; e.g., by mounting tape, or a sleeve attached to a chuck, such as with Dupont™ CRYEL® round plates.

As used herein, "feature" means a raised projection of a flexographic printing plate. The raised projection has a distal surface (or land), onto which material may be disposed.

As used herein, "donor substrate" means a substrate onto which a material transferable to a feature of a flexographic printing plate may be disposed. Donor substrates may be in any form suitable for the transfer of material to a feature. For example, donor substrates may be films, plates or rolls.

As used herein, "recipient substrate" means a substrate onto which a material may be printed. Exemplary substrates include but are not limited to inorganic substrates such as quartz, glass, silica and other oxides or ceramics such as alumina, indium tin oxide, lithium tantalate (LiTaO.sub.3), lithium niobate (LiNbO.sub.3), gallium arsenide (GaAs), silicon carbide (SiC), langasite (LGS), zinc oxide (ZnO), aluminum nitride (AlN), silicon (Si), silicon nitride (Si.sub.3N.sub.4), and lead zirconium titanate ("PZT"); metals or alloys such as aluminum, copper, gold, silver and steel; thermoplastics such as polyesters (e.g., polyethylene terephthalate or polyethylene naphthalates), polyacrylates (e.g., polymethyl methacrylate or "PMMA"), poly(vinyl acetate) ("PVAC"), poly(vinylbutyral) ("PVB)", poly(ethyl acrylate) ("PEA"), poly(diphenoxyphosphazene) ("PDPP"), polycarbonate ("PC"), polypropylene ("PP"), high density polyethylene ("HDPE"), low density polyethylene ("LDPE"), polysulfone ("PS"), polyether sulfone ("PES"), polyurethane ("PUR"), polyamide ("PA"), polyvinyl chloride ("PVC"), polyvinylidene fluoride ("PVdF"), polystyrene and polyethylene sulfide; and thermoset plastics such as cellulosic derivatives, polyimide, polyimide benzoxazole and polybenzoxazole. Other recipient substrates could be paper, nonwovens and foams. Preferably care is taken when selecting the substrate so that there will be an adequate degree of adhesion between the substrate and the material.

As used herein, "comprising" and "including" are used in an open-ended fashion, and thus should be interpreted to mean "including, but not limited to . . . ".

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Materials to be Printed

Any curable material capable of being transferred to and from a feature of a flexographic printing plate may be used in accordance with the teachings presented herein. For example the material may comprise a curable resin.

Illustrative examples of resins that are capable of being polymerized by a free radical mechanism that can be used herein include acrylic-based resins derived from epoxies, polyesters, polyethers, and urethanes, ethylenically unsaturated compounds, aminoplast derivatives having at least one pendant acrylate group, isocyanate derivatives having at least one pendant acrylate group, epoxy resins other than acrylated epoxies, and mixtures and combinations thereof. The term acrylate is used here to encompass both acrylates and methacrylates. U.S. Pat. No. 4,576,850 (Martens) discloses examples of cross-linkable resins that may be used in cube corner element arrays and may be useful as the materials described herein.

Ethylenically unsaturated resins include both monomeric and polymeric compounds that contain atoms of carbon, hydrogen and oxygen, and optionally nitrogen, sulfur, and the halogens may be used herein. Oxygen or nitrogen atoms, or both, are generally present in ether, ester, urethane, amide, and urea groups. Ethylenically unsaturated compounds preferably have a molecular weight of less than about 4,000 and preferably are esters made from the reaction of compounds containing aliphatic monohydroxy groups, aliphatic polyhydroxy groups, and unsaturated carboxylic acids, such as acrylic acid, methacrylic acid, itaconic acid, crotonic acid, iso-crotonic acid, maleic acid, and the like. Such materials are typically readily available commercially and can be readily cross linked.

Some illustrative examples of compounds having an acrylic or methacrylic group that are suitable for use in accordance with the teachings presented herein are listed below:

(1) Monofunctional Compounds:

ethylacrylate, n-butylacrylate, isobutylacrylate, 2-ethylhexylacrylate, n-hexylacrylate, n-octylacrylate, isooctyl acrylate, bornyl acrylate, tetrahydrofurfuryl acrylate, 2-phenoxyethyl acrylate, and N,N-dimethylacrylamide;

(2) Difunctional Compounds:

1,4-butanediol diacrylate, 1,6-hexanediol diacrylate, neopentylglycol diacrylate, ethylene glycol diacrylate, triethyleneglycol diacrylate, tetraethylene glycol diacrylate, and diethylene glycol diacrylate; and (3) Polyfunctional Compounds:

trimethylolpropane triacrylate, glyceroltriacrylate, pentaerythritol triacrylate, pentaerythritol tetraacrylate, and tris (2-acryloyloxyethyl)isocyanurate. Some representative examples of other ethylenically unsaturated compounds and resins include styrene, divinylbenzene, vinyl toluene, N-vinyl formamide, N-vinyl pyrrolidone, N-vinyl caprolactam, monoallyl, polyallyl, and polymethallyl esters such as diallyl phthalate and diallyl adipate, and amides of carboxylic acids such as N,N-diallyladipamide.

Illustrative examples of photopolymerization initiators that can be blended with acrylic compounds include the following: benzil, methyl o-benzoate, benzoin, benzoin ethyl ether, benzoin isopropyl ether, benzoin isobutyl ether, etc., benzophenone/tertiary amine, acetophenones such as 2,2-diethoxyacetophenone, benzyl methyl ketal, 1-hydroxycyclohexylphenyl ketone, 2-hydroxy-2-methyl-1-phenylpropan-1-one, 1-(4-isopropylphenyl)-2-hydroxy-2-methylpropan-1-one, 2-benzyl-2-N,N-dimethylamino-1-(4-morpholinophenyl)-1-butanone, 2,4,6-trimethylbenzoyldiphenylphosphine oxide, 2-methyl-1-4(methylthio), phenyl-2-morpholino-1-propanone, bis(2,6-dimethoxybenzoyl)(2,4,4-trimethylpentyl)phosphine oxide, etc. The compounds may be used individually or in combination.

Examples of thermal initiators that may be employed generally include peroxides such as acetyl and benzoyl peroxides. Specific examples of thermal initiators that can be utilized include, but are not limited to, 4,4'-azobis(4-cyanovaleric acid), 1,1'-azobis(cyclohexanecarbonitrile), 2,2'-azobis(2-methylpropionitrile), benzoyl peroxide, 2,2-bis(tert-butylperoxy)butane, 2,5-bis(tert-butylperoxy)-2,5-dimethylhexane, bis[1-(tert-butylperoxy)-1-methylethyl] benzene, tert-butyl hydroperoxide, tert-butyl peracetate, tert-butyl peroxide, tert-butyl peroxybenzoate, cumene hydroperoxide, dicumyl peroxide, lauroyl peroxide, peracetic acid, and, potassium persulfate. As examples, the photoinitiator may be α-hydroxyketone, phenylglyoxylate, benzildimethyl ketal, α-aminoketone, monoacylphosphine, bisacylphosphine, and mixtures thereof.

Cationically polymerizable materials include E but are not limited to materials containing epoxy and vinyl ether functional groups, and may be used herein. These systems are photoinitiated by onium salt initiators, such as triarylsulfonium, and diaryliodonium salts.

Materials may also comprise a solvent. Any solvent in which the components of the material may be dissolved, dispersed, suspended or the like may be used. The solvent may be an organic compound that does not appreciably participate in the cross-linking reaction and which exists in a liquid phase at room temperature and 1 atmosphere. The viscosity and surface tension of the solvent are not specifically limited. Examples of suitable solvents include chloroform, acetonitrile, methylethylketone, ethylacetate, and mixtures thereof. Any amount of solvent capable of dissolving, dispersing, suspending, etc. the components of the material may be used. Preferably, a sufficient amount of solvent will be used so that the material can readily be disposed on a donor substrate. Generally, the amount of solvent will range from 60 to 90 wt %, e.g. 70 to 80 wt %, with respect to the total weight of the material.

In addition, the solvent or mixture of solvents should be actively or passively removable from the material during a flexographic printing process to produce a material that may be cured when the material is in contact with both the feature of the flexographic printing plate and the recipient substrate. A curable material is preferably a flowable material at room temperature or at temperatures at which flexographic printing processes are carried out.

Methods

Figure 2:
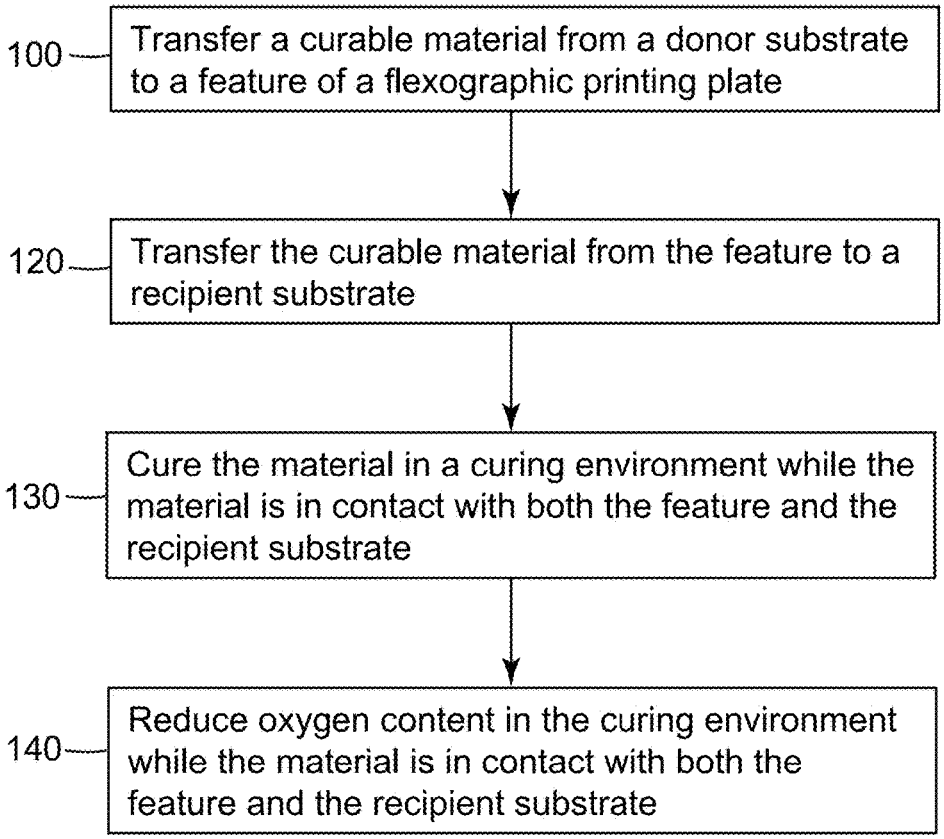

Exemplary methods for printing a material on a recipient substrate using flexographic printing techniques are described below. FIG. 1 provides an example of such a method. The method depicted in FIG. 1 comprises transferring a curable material from a donor substrate to a feature of a flexographic printing plate (100). The curable material is then transferred from the feature to a recipient substrate (120). The method further comprises curing the material when the material is in contact with both the feature and the recipient substrate (130). As shown in FIG. 2, the method may further comprise reducing the oxygen content in the environment where the material is in contact with the feature and the recipient substrate; i.e., in the curing environment. This can be done, e.g., by introducing nitrogen into the curing environment.

Any known or future developed technique for curing the material may be used in accordance with the methods described herein. For example, e-beam radiation may be used to initiate cross-linking within the material. Alternatively, heat or UV radiation may be used. If heat or UV radiation is used, it may be desirable to include a photo initiator or a thermal initiator in the material composition. It will be understood that the energy source will be positioned such that emitted energy will be effective to cure the material while it is contact with the feature and the recipient substrate. For example, if UV radiation is used to cure the material, the substrate, or alternatively the printing plate and feature, and perhaps the flexographic roll, may be penetrable by the UV radiation so that the radiation can reach the material when it is in contact with both the feature and the substrate. If heat is used, the recipient substrate may be preheated prior to transfer of the material from the feature to the substrate so that the material may be cured when it is in contact with both the feature and the substrate. Other possibilities are envisioned and readily understandable by those of skill in the art.

Figure 3:
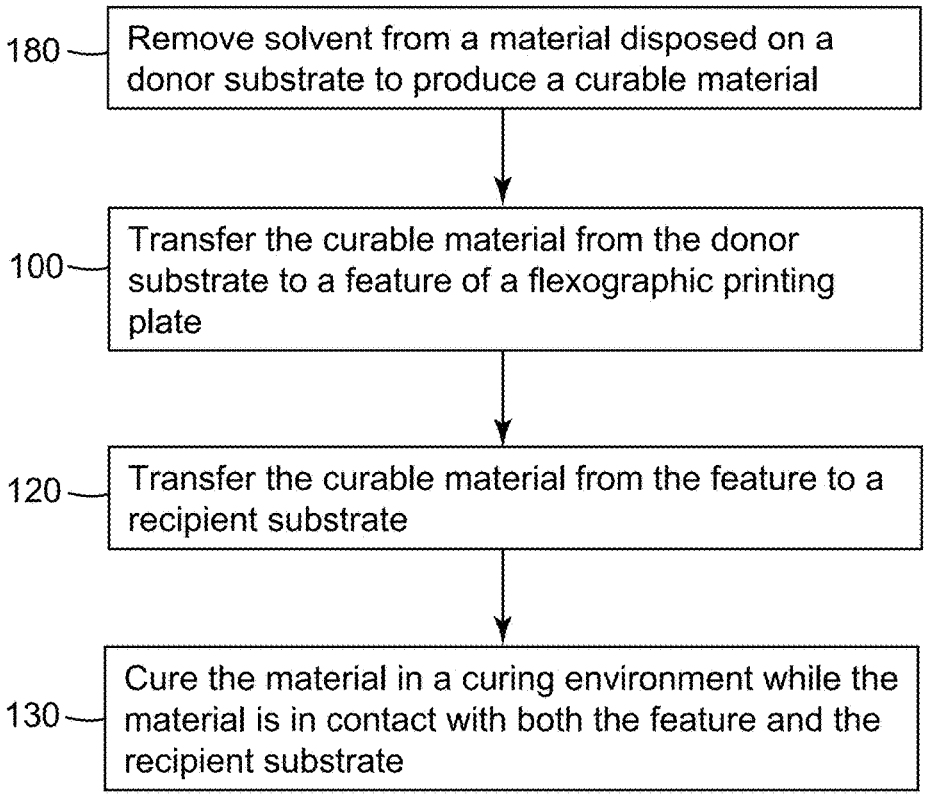

As shown in FIG. 3, a method for flexographic printing may comprise removing solvent from a material disposed on a donor substrate to produce a curable material (180). In most cases, at least a portion of the solvent will be removed from a material prior to the material being cured. Any known or future developed technique suitable for removing solvent from the material may be employed. Solvent may be removed from the material according to the teachings described in the aforementioned U.S. Patent Publication No. 2010-0024671, entitled "SOLVENT-ASSISTED EMBOSSING OF FLEXOGRAPHIC PRINTING PLATES" to Pekurovsky et al.

Figure 4:
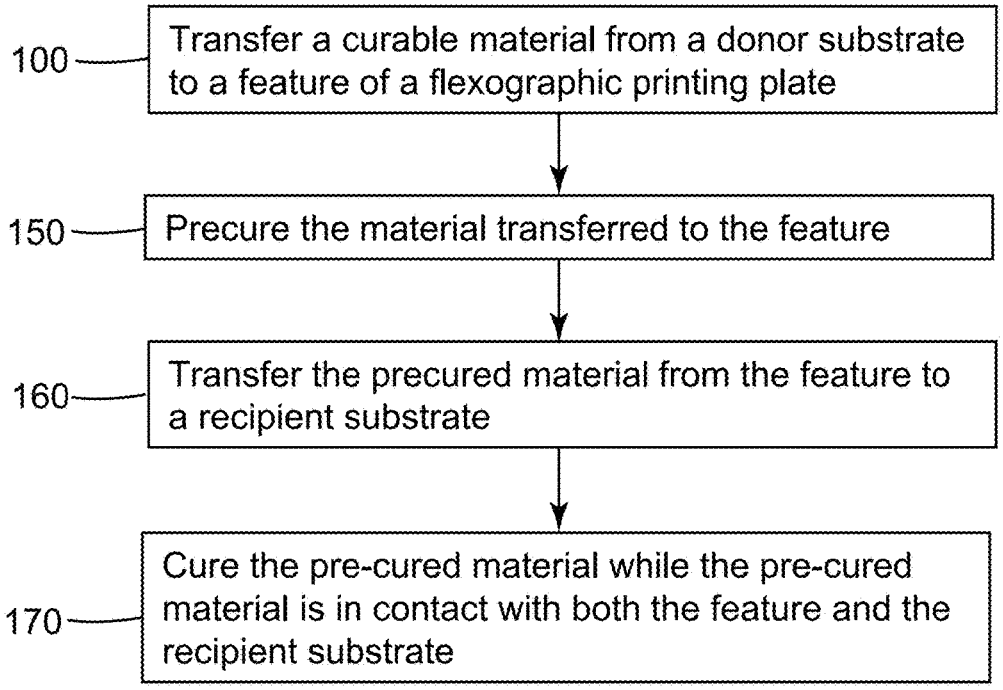

FIG. 4 illustrates an exemplary method for flexographic printing. The method comprises transferring a curable material from a donor substrate to a features of a flexographic printing plate (100) and precuring the material transferred to the feature (150). The material may be precured as described above for curing. It will be understood that precuring the material will result in a material that is partially cured by the time the material comes into contact with the recipient substrate. The method further comprises transferring the precured material from the feature to a recipient substrate (160) and curing the pre-cured material while the pre-cured material is in contact with both the feature and the recipient substrate.

It will be understood that various steps presented in FIGS. 1-4 may be intermixed, interchanged, combined, etc. as appropriate. For example, the step of reducing the oxygen content in the curing environment (140) in FIG. 2 may be applied to the methods shown in FIGS. 3 and 4; the step of removing a solvent from a material on a donor substrate (180) shown in FIG. 3 may be performed with the methods shown in FIGS. 2 and 4; etc.

Systems

The methods described above can be carried out with any suitable flexographic printing system. Exemplary flexographic systems and components thereof suitable for carrying out the methods described above are described below. In describing the exemplary systems, the term material 220 will be used for convenience in describing both material that comprises a high solvent concentration, curable material and pre-cured material. It should be understood that (i) material 220 when initially disposed on a donor substrate may comprise a fully saturated solution, (ii) solvent may be removed, actively or passively, from material 220 prior to transfer to a feature of a flexographic printing plate to produce a curable material, (iii) curable material 220 may be pre-cured while disposed on the feature and (iv) material 220 transferred to the recipient substrate will be cured or further cured.

Figure 5A:
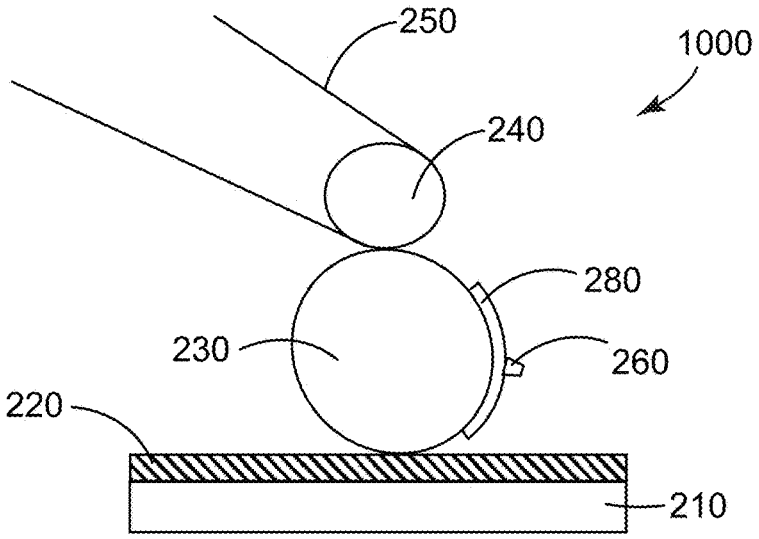
FIGS. 5-9 are side views of diagrammatic representations of flexographic printing systems or components thereof.
Figure 5B:
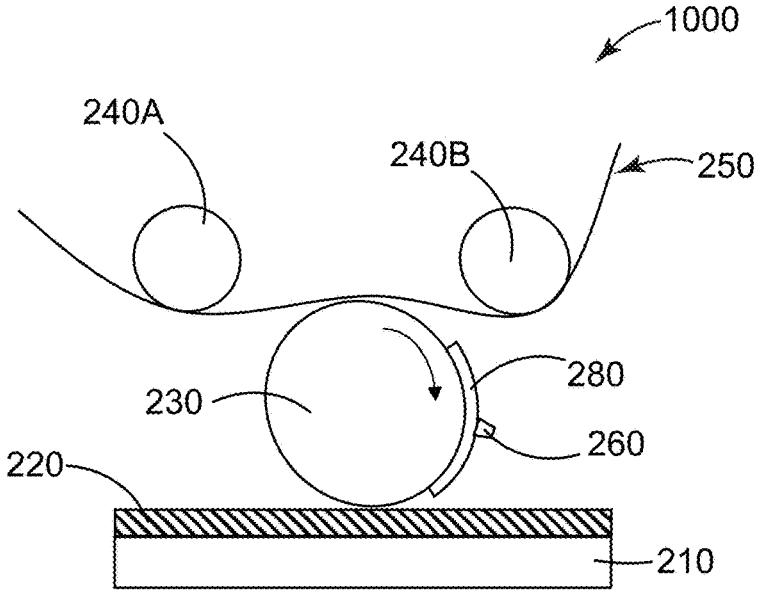

Referring to FIG. 5, side views of systems 1000 for flexographic printing are illustrated. The system 1000 comprises a donor substrate 210 configured to receive material 220 to be printed on a recipient substrate 250. The system 1000 includes a flexographic roll 230 configured to attachably receive a flexographic printing plate 280. Flexographic printing plate 280 may be attached to flexographic roll 230 using any suitable technique. One suitable technique includes attaching flexographic plate 280 to flexographic roll 230 using an adhesive.

Flexographic roll 230 is moveable relative to the donor substrate 210 such that material 220 may be transferred from donor substrate 210 to a feature 260 of a flexographic printing plate 280. The system 1000 depicted in FIG. 5A further includes a backup roll 240 positioned relative to flexographic roll 230 such that movement of backup roll 240 relative to flexographic roll 230 is capable of causing recipient substrate 250 to move between flexographic roll 230 and backup roll 240, allowing material 220 to be transferred from feature 260 of printing plate 280. The system 1000 depicted in FIG. 5B includes two backup rolls 240A, 240B positioned relative to flexographic roll 230 such that movement of backup rolls 240A, 240B relative to flexographic roll 230 is capable of causing recipient substrate 250 to move between flexographic roll 230 and backup rolls 240A, 240B, allowing material 220 to be transferred from feature 260 of printing plate 280.

Flexographic roll 230 and substrate roll 240, 240A, 240B depicted in FIG. 5 may be in the form of cylinders and the rolls 230, 240, 240A, 240B may rotate about the respective central axes of the cylinders. Such rotation allows printing plate 280 attached to flexographic roll 230 to contact material 220 and then transfer material 220 to recipient substrate 250. Such rotation also allows recipient substrate 250 to move between flexographic roll 230 and substrate roll 240, 240A, 240B.

Figure 5C:
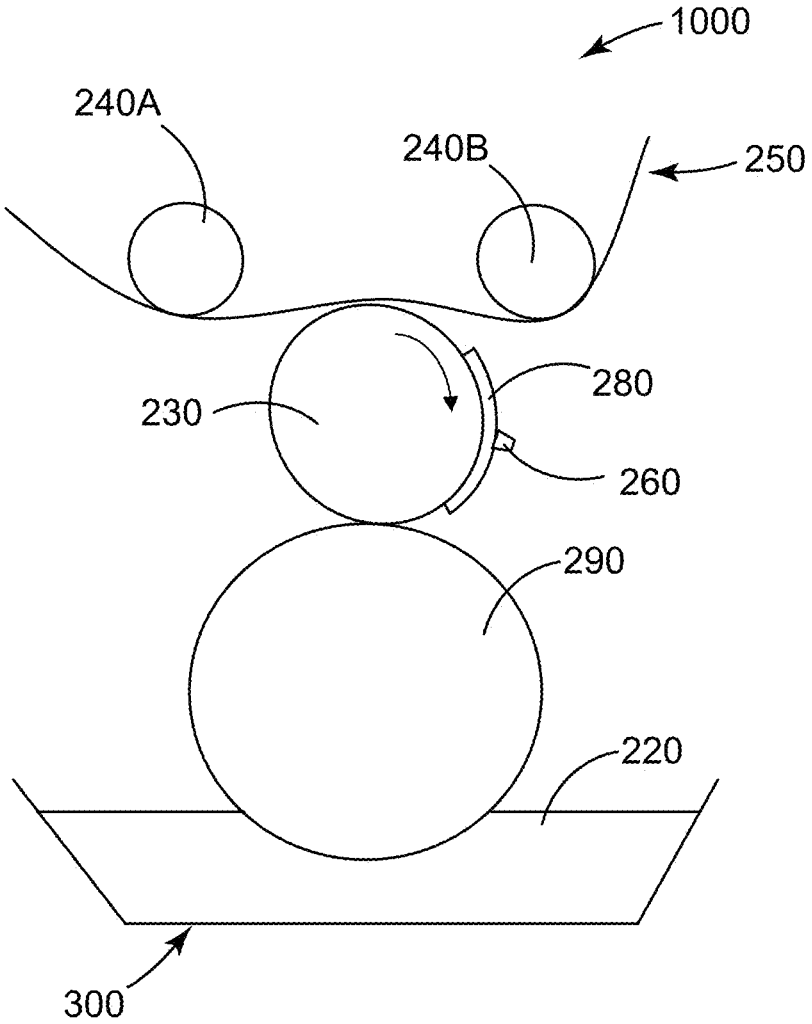

The system 1000 depicted in FIG. 5C includes a reservoir 300 for housing material 220. As inking roll 290 rotates about its central axis and relative to reservoir 300, material 220 is transferred to donor substrate 210. However, it will be understood that nearly any method may be used to dispose material 220 onto inking roll 290, including, for example, die coating and roll coating. Flexographic roll 230, to which flexographic plate 280 may be attached, rotates relative to inking roll 290 such that material 220 is transferred to feature 260 of flexographic printing plate 280. In the system 1000 shown in FIG. 5C, solvent may be passively removed from material 220; e.g., through evaporation. As described with regard to FIGS. 5A and B, material 220 material may then be transferred from feature 260 of plate 280 to recipient substrate 250.

Figure 6:
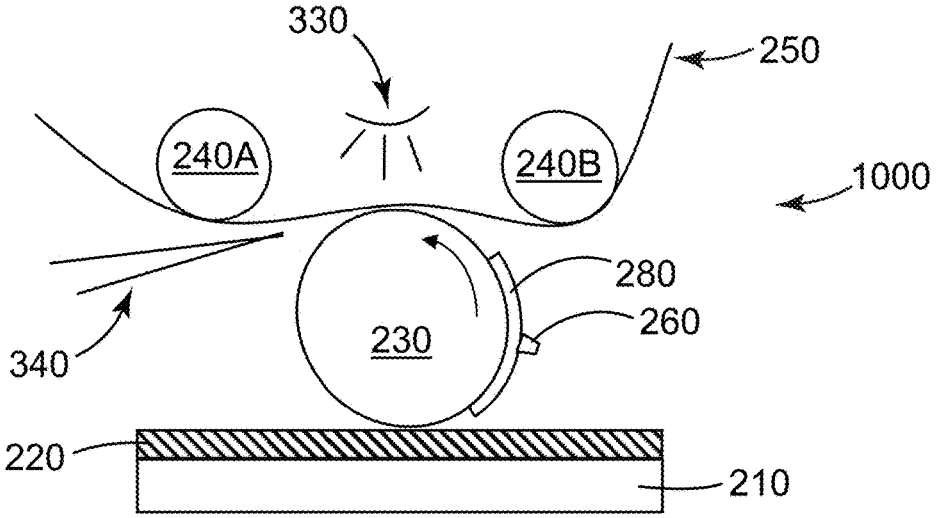
Figure 7:
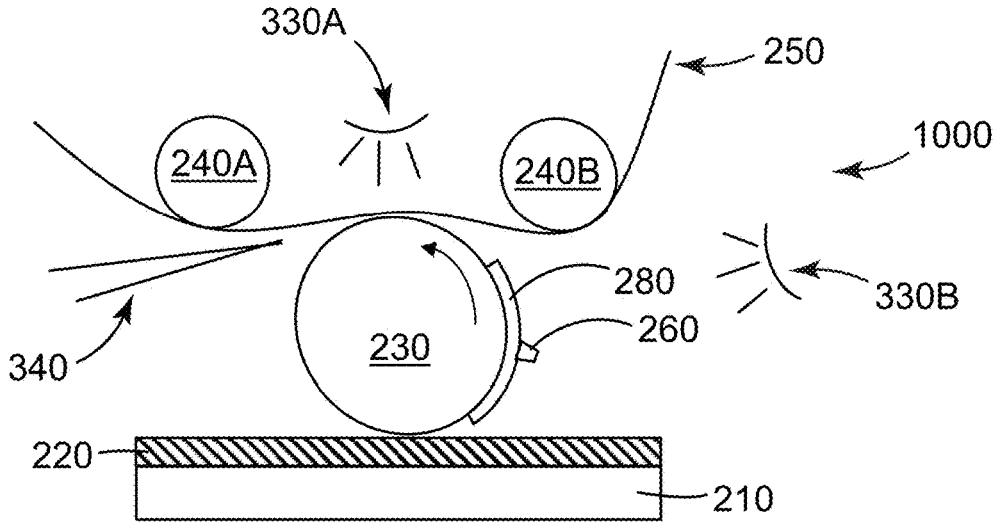
Figure 8A:
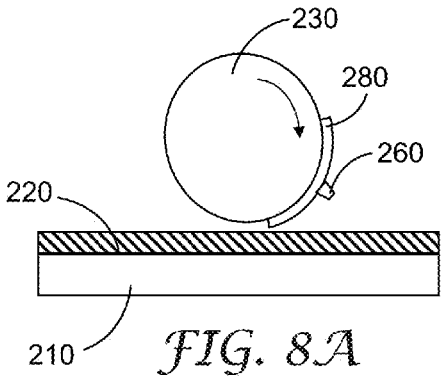
Figure 8B:
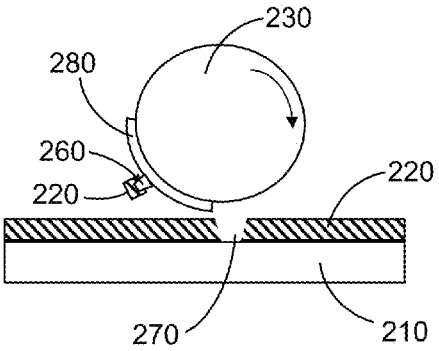
Figure 8C:
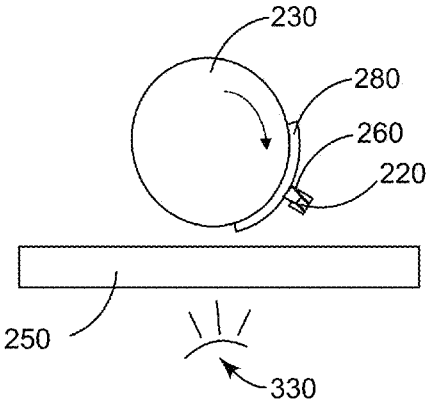
Figure 8D:
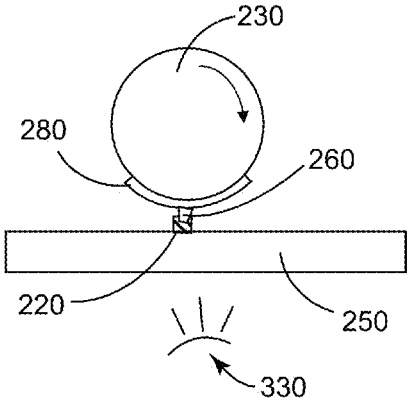

Referring to FIGS. 6 and 7, flexographic printing systems 1000 having one or more energy source 330, 330A, 330B are shown. As shown in FIGS. 6 and 7, energy source 330, 330A is positioned such that emitted energy can cure material while material 220 is in contact with both feature 260 of printing plate 280 and recipient substrate 250. If energy source 330, 330A emits radiation, recipient substrate 250 should be substantially transparent to the radiation to allow curing of the material 220. Of course it will be understood that energy source 330, 330A may be placed at any location suitable for curing material 220 as it is in contact with both feature 260 and recipient substrate 250. For example, energy source 330, 330A may be placed within backup roll 240 (e.g., in FIG. 5A) or flexographic roll 230. As depicted in FIGS. 6 and 7, the systems 1000 may further comprise a nitrogen infusion apparatus 340 configured to introduce nitrogen to the location where the material is transferred from the feature 260 to the recipient substrate 250 to facilitate curing of the material 220. As shown in FIG. 7, a system 1000 may comprise a second energy source 330B for pre-curing the material 220 prior to transfer to recipient substrate 250. Pre-curing of the material 220 can serve to obtain a material 220 having properties; e.g. viscosity, thickness, adhesion, tack, etc., desirable for transferring the material 220 from the feature 260 to the recipient substrate 250.

Referring to FIG. 8, a flexographic roll 230 to which a flexographic plate 280 is attached is shown. As the flexographic roll 230 rotates relative to donor substrate 210, feature 260 of the flexographic plate 280 contacts material 220 disposed on donor substrate 210 and material 220 is transferred to feature 260. If material 220 is viscous; e.g. if solvent has been removed from material 220, an imprint 270 may be left on donor substrate 210. As flexographic roll 230 continues to rotate, relative to recipient substrate 250, material 220 disposed on feature 260 comes into contact with recipient substrate 250. While material 220 is in contact with both feature 260 and recipient substrate 250, material 220 is cured, initiated by energy emitted from energy source 330.

Figure 9:
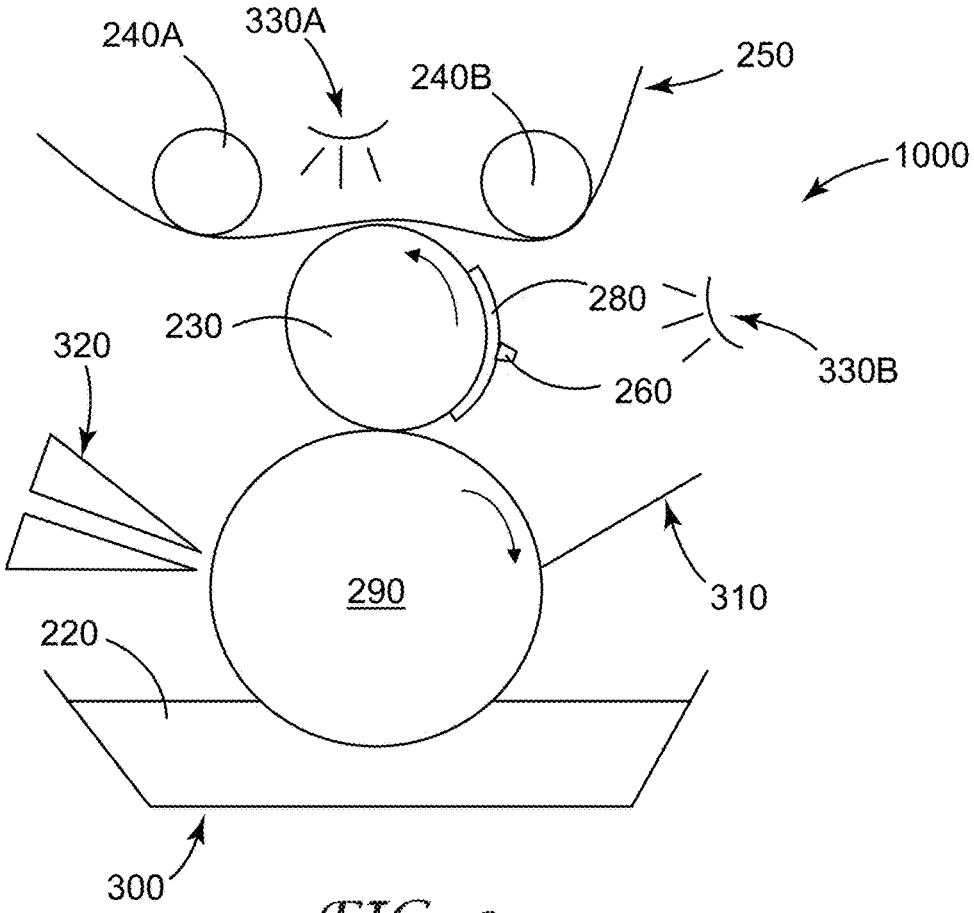

Referring to FIG. 9, a side view of another exemplary flexographic printing system 1000 is illustrated. FIG. 9 depicts a system 1000 having a solvent removal apparatus 320. Any apparatus capable of removing solvent from material 220 on donor substrate 210 associated with inking roll 290 may be employed. Examples of suitable solvent removal apparatuses 320 include microwave or infrared radiation apparatuses to assist in solvent evaporation or dryers. Also depicted in FIG. 9 is a doctor blade 310. Blade 310 is in contact with at least a portion of donor substrate 210, which is associated with inking roll 290. Blade 310 is capable of at least partially removing one or more imprints 270 from donor substrate 210. Of course it will be understood that any apparatus for removing or reducing imprints may be used. Once imprints 270 are removed, donor substrate 210, which is associated with inking roll 290, is rendered suitable for receiving additional material 220.

Of course it will be understood that the components of the various systems 1000 discussed throughout this disclosure can be interchanged. For example, the system 1000 of FIG. 5, 6 or FIG. 7 may include a solvent removal apparatus 320 or a blade 310 as depicted in FIG. 9. In addition, it will be understood that donor substrate 210, which is shown as a film or plate in FIGS. 5A, 5B, and 6-8 may be in the form of a roll or attached to a roll, as depicted in FIGS. 5C and 9.

EXAMPLE

A micro-flexographic printing plate was prepared as described in U.S. Patent Publication No. 2010-0024671, entitled "SOLVENT-ASSISTED EMBOSSING OF FLEXOGRAPHIC PRINTING PLATES" to Pekurovsky et al. Briefly, the plate was prepared by taking a polymeric film having a micro-replicated linear prismatic structure (BEF 90/50, commercially available from 3M Co.), referred to as BEF master, depositing a thin layer of methyl ethyl ketone on its structured surface, and then positioning a CYREL® flexographic plate (type TDR B 6.35 mm thick, with removed cover sheet, commercially available from DuPont Co.) on the top of the microreplicated surface. After 15 hours, the CYREL® plate was exposed to UV radiation through the attached micro-replicated film in a UV processor equipped with a mercury Fusion UV curing lamp (model MC-6RQN, Rockville, Md., 200 watt/in), run at approximately 5 fpm. The micro-replicated flexographic printing plate was then detached from the BEF master.

Figure 10:
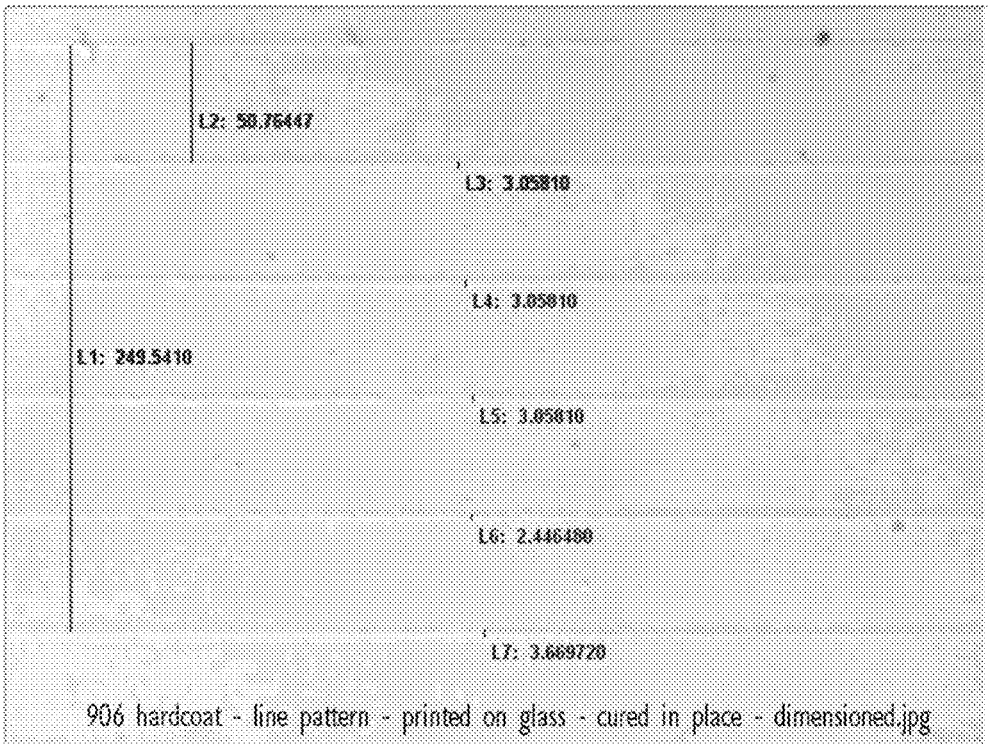
FIG. 10 is a micrograph image of hardcoat lines printed on a glass slide using an exemplary system and method.

The microreplicated flexographic printing plate was then attached to a 12.7 cm-diameter glass cylinder by flexographic mounting tape (type 1120, commercially available from 3M Co.). A thin layer of type 906 hardcoat (33 wt % solids ceramer hardcoat dispersion containing 32 wt % 20 nm $SiO_2$ nano-particles, 8 wt % N,N-dimethyl acrylamid, 8 wt % methacryloxypropyl trimethoxysilane and 52 wt % pentaerythritol tri/tetra acrylate (PETA) in isopropylalcohol (IPA), 3M Co., St. Paul, Minn.) was deposited onto a clean glass slide by dip coating at 0.03 meters per minute from the 906 hardcoat solution in IPA (25 wt % solids), and then drying the glass slide in open air. The flexographic printing plate was then rolled by hand in the layer of hardcoat and then rolled onto a clean glass slide. The glass slide was positioned directly above a light fiber of a UV spot cure system (Lightingcure 200, Model #L7212-01, Hamamatsu Photonics K.K. Japan). Lines that were exposed to the UV light were cured and had a width of approximately 3 micrometers and were spaced approximately 50 micrometers apart forming a parallel line pattern illustrated with the micrographic image of FIG. 10.

Thus, embodiments of the FLEXOGRAPHIC PRINTING WITH CURING DURING TRANSFER TO SUBSTRATE are disclosed. One skilled in the art will appreciate that embodiments other than those disclosed are envisioned. The disclosed embodiments are presented for purposes of illustration and not limitation, and the present invention is limited only by the claims that follow.

What is claimed is:

1. A flexographic printing system comprising:

a donor substrate configured to receive a curable material;

a flexographic roll configured to attachably receive a flexographic printing plate comprising a feature, the feature including one or more raised projections, the flexographic roll positioned adjacent to the donor substrate and rotatable relative to the donor substrate to receive the curable material only on the one or more raised projections of the flexographic printing plate;

one or more backup rolls positioned relative to the flexographic roll such that movement of the one or more backup rolls relative to the flexographic roll is capable of causing a recipient substrate to move between the one or more backup rolls and the flexographic roll to allow the curable material to be transferred from the one or more raised projections to the recipient substrate; and a first energy source for curing the material, the first energy source positioned to cause curing of the material while the material is in contact with both the feature and the recipient substrate.

2. A flexographic printing system according to claim 1, wherein the first energy source is capable of emitting UV radiation to cure the material.

3. A flexographic printing system according to claim 1, wherein the first energy source is positioned so that energy emitted from the energy source will penetrate the recipient substrate to cure the material while the material is in contact with both the feature and the recipient substrate.

4. A flexographic printing system according to claim 1, further comprising a second energy source for precuring the material, the second energy source positioned to cause precuring of the material prior to transfer of the material from the feature to the recipient substrate.

5. A flexographic printing system according to claim 1, further comprising a nitrogen infusion apparatus configured to introduce nitrogen at a location where material is transferred from the feature to the recipient substrate.

6. A flexographic printing system according to claim 1, wherein the donor substrate is configured to receive a material comprising a solvent such that the material is disposed on the donor substrate.

7. A flexographic printing system according to claim 6, further comprising a solvent removal apparatus capable of removing the solvent from the material disposed on the donor substrate to produce the curable material disposed on the donor substrate.

8. A flexographic printing system according to claim 1, further comprising the flexographic printing plate.

9. A flexographic printing system according to claim 8, wherein the feature comprises a lateral dimension of less than 15 μm.

10. A flexographic printing system according to claim 1, wherein the one or more backup rolls comprises first and second backup rolls that are positioned to have a portion of the recipient substrate therebetween to face the flexographic roll.

11. A flexographic printing system according to claim 10, wherein the curable material is transferred from the one or more raised projections of the flexographic printing plate to the recipient substrate when the recipient substrate is between the first backup roller and the second back-up roller.

12. A flexographic printing system according to claim 1, wherein the recipient substrate is a flexible recipient substrate.

* * * * *